US007666119B1

(12) United States Patent
Jhang

(10) Patent No.: US 7,666,119 B1
(45) Date of Patent: Feb. 23, 2010

(54) HURDLE ASSEMBLY

(76) Inventor: Jhih-Hao Jhang, No. 474, Yijiao Street, Chiayi City (TW)

( * ) Notice: Subject to any disclaimer, the term of this patent is extended or adjusted under 35 U.S.C. 154(b) by 0 days.

(21) Appl. No.: 12/358,135

(22) Filed: Jan. 22, 2009

(51) Int. Cl.
*A63B 21/00* (2006.01)

(52) U.S. Cl. ..... 482/23; 482/36; 482/41

(58) Field of Classification Search ..... 482/23–42, 482/66; 280/818, 14.1; D21/224
See application file for complete search history.

(56) References Cited

U.S. PATENT DOCUMENTS 5,509,432 A * 4/1996 Peterson ..... 135/65
2008/0029139 A1* 2/2008 Pijanowski ..... 135/67

* cited by examiner

*Primary Examiner*—Jerome Donnelly
(74) *Attorney, Agent, or Firm*—Christensen O'Connor Johnson Kindness PLLC

(57) ABSTRACT

A hurdle assembly includes spaced-apart left and right legs, a cross bar having two longitudinally opposite ends connected respectively to top ends of the legs, and at least one top frame including a vertical support section, a barring section extending longitudinally and horizontally parallel to the cross bar and having an end connected to a top end of the vertical support section, and a clamp element connected to a bottom end of the vertical support section and clamping releasably the cross bar in proximity to one end thereof.

9 Claims, 12 Drawing Sheets

HURDLE ASSEMBLY

BACKGROUND OF THE INVENTION

1. Field of the Invention

This invention relates to a hurdle, more particularly to a hurdle assembly with an adjustable height.

2. Description of the Related Art

Referring to FIGS. 1 and 2, a conventional hurdle assembly 1 is shown to include a bottom frame 11, a looped top frame 13, and a twin clamp 12 connected to the top frame 13 and the bottom frame 11. The bottom frame 11 has spaced-apart left and right legs 111, and a cross bar 112 interconnecting top ends of the left and right legs 111. The twin clamp 12 has upper and lower clamp members 121 respectively clamping the top frame 13 and the cross bar 112. Each of the upper and lower clamp members 121 has a substantially C-shaped cross section.

The height of the conventional hurdle assembly 1 may be adjusted according to an athlete's requirement during use. For example, the top frame 13 may be disposed above the cross bar 112 so as to place the total height of the conventional hurdle assembly 1 at a high level, or may be disposed below the cross bar 112 so as to place the total height of the conventional hurdle assembly 1 at a low level.

However, because the top frame 13 is looped, a significant amount of material is needed for the top frame 13 during production of the same. Further, the total height of the conventional hurdle assembly 1 can only be adjusted to two different heights, i.e., the high and low levels. For athletes of different skill levels or when more variety is desired for training purposes, the conventional hurdle assembly 1 does not provide for sufficient adjustability. Moreover, since the cross bar 112 and the top frame 13 are circular in cross section, and since the top frame 13 is connected to the cross bar 112 through the twin clamp 12, when the top frame 13 is disposed above the cross bar 112 and is bumped by an athlete, the top frame 13 and the twin clamp 12, as shown in phantom lines in FIG. 2, are pushed to move inclinedly relative to the cross bar 112 so that the total height of the conventional hurdle assembly 1 is reduced. The athlete must adjust the top frame 13 to the highest level again when this kind of situation is encountered so that use of the conventional hurdle assembly 1 is troublesome. Additionally, since the legs 111 are fixed to the cross bar 112, the conventional hurdle assembly 1 occupies a substantial space during transport and storage.

SUMMARY OF THE INVENTION

Therefore, an object of the present invention is to provide a hurdle assembly that has a reduced volume so as to reduce the material costs to a minimum.

Another object of the present invention is to provide a hurdle assembly that can be adjusted to different height levels.

According to this invention, a hurdle assembly comprises a bottom frame and at least one top frame. The bottom frame includes spaced-apart left and right legs, and a cross bar having two longitudinally opposite first and second ends connected respectively to top ends of the left and right legs. The top frame includes a vertical support section, a barring section extending longitudinally and horizontally parallel to the cross bar and having an end connected to a top end of the vertical support section, and a clamp element connected to a bottom end of the vertical support section and clamping releasably the cross bar in proximity to one of the first and second ends of the cross bar.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
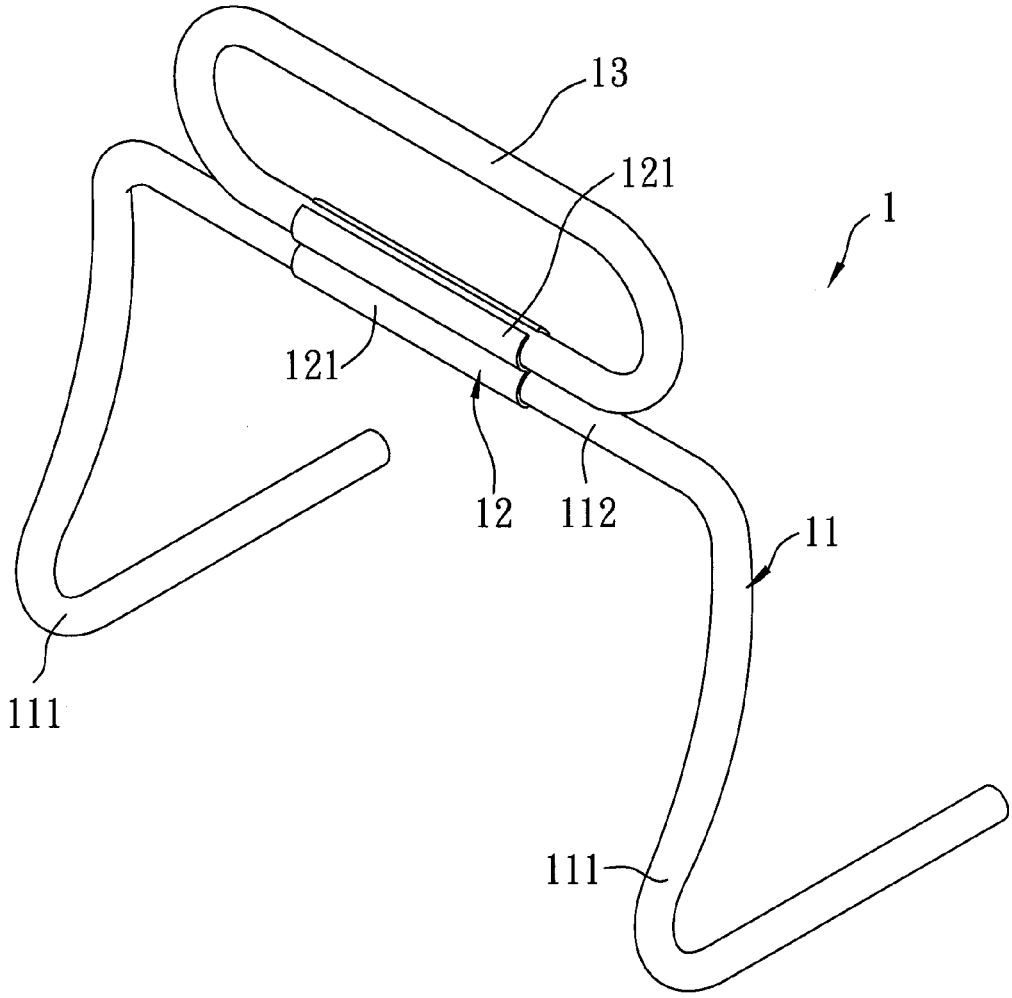
FIG. 1 PRIOR ART
FIG. 1 is a perspective view of a conventional hurdle assembly.
Figure 2:
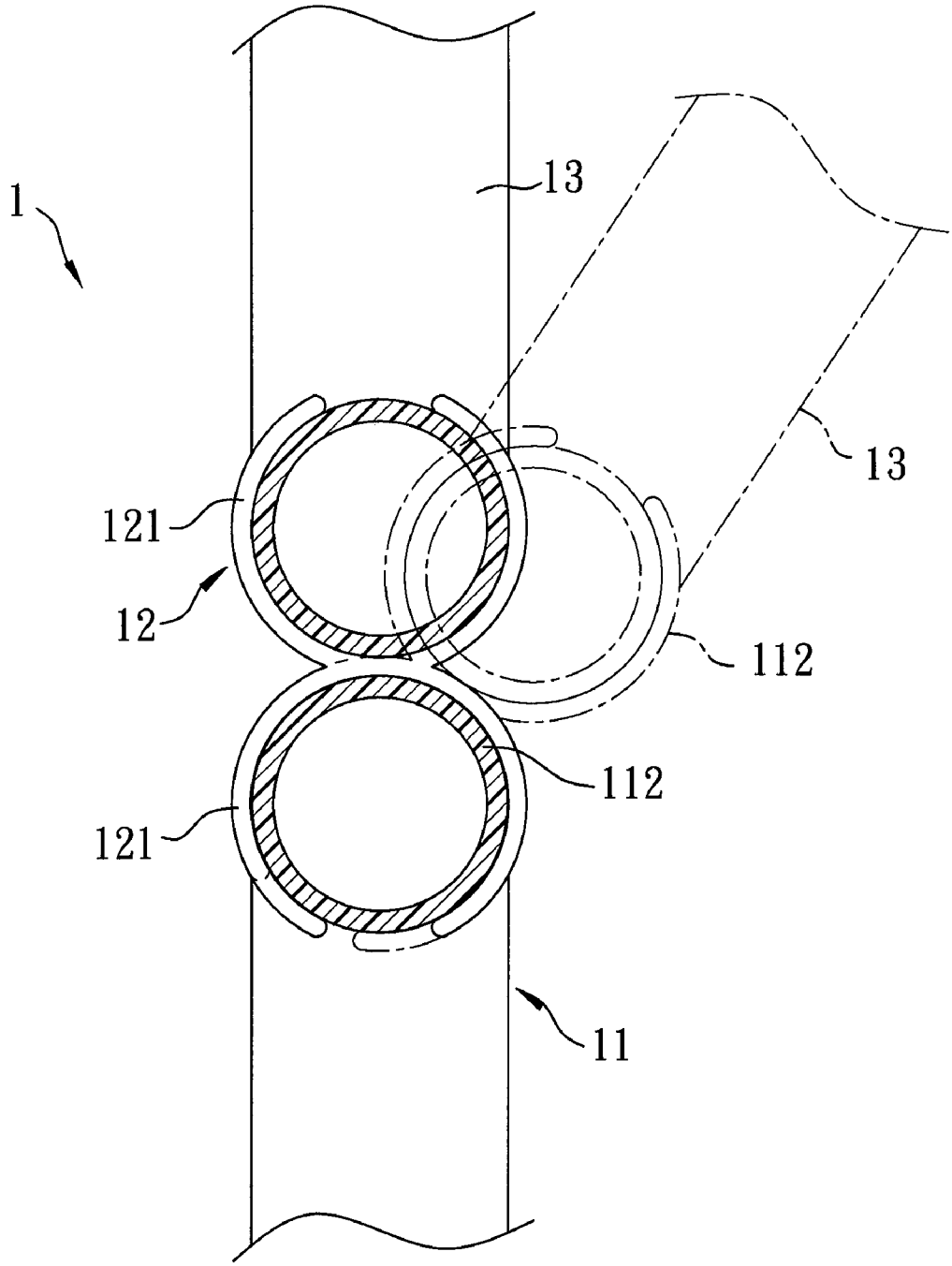
FIG. 2 PRIOR ART
FIG. 2 is a fragmentary sectional view of the conventional hurdle assembly of FIG. 1.

Before the present invention is described in greater detail, it should be noted that the same reference numerals have been used to denote like elements throughout the specification.

Referring to FIGS. 3 to 8, a hurdle assembly according to the first preferred embodiment of the present invention is shown to comprise a bottom frame 3 and a top frame 4.

The bottom frame 3 includes spaced-apart substantially L-shaped left and right legs 31, and a cross bar 32 of non-circular cross section. Each of the left and right legs 31 has a horizontal leg section 311 adapted to be supported on the ground, and a vertical leg section 312 extending upwardly from a front end of the horizontal leg section 311 and having a tubular wall 313 at a top end thereof. The tubular wall 313 has a vertical rib 315 projecting inwardly from an inner face thereof, a plurality of angularly spaced-apart vertical slits 318 below the vertical rib 315, and two pairs of diametrically opposed transverse ribs 317 each projecting inwardly and transversely from the inner face of the tubular wall 313 between two adjacent ones of the vertical slits 318.

Figure 4:
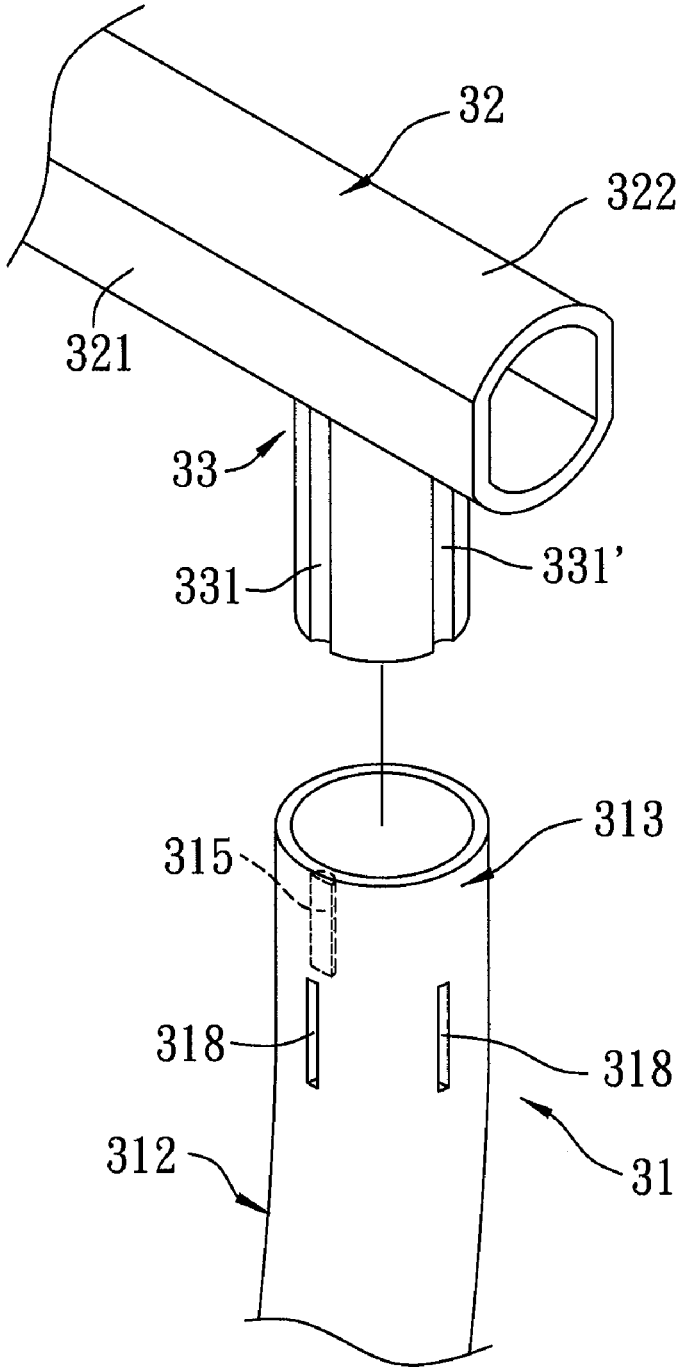
FIG. 4 is a fragmentary exploded perspective view of the first preferred embodiment.

The cross bar 32 has two longitudinally opposite first and second ends 320, 320', longitudinal front and rear flat faces 321 extending between the first and second ends 320, 320', longitudinal top and bottom rounded faces 322 interconnecting the front and rear flat faces 321, and two insert posts 33 (only one is shown in FIG. 4) extending downwardly from the bottom rounded face 322 at the respective first and second ends 320, 320' and inserted into the tubular walls 313 of the respective left and right legs 31. Each insert post 33 has an outer peripheral face provided with two vertically extending grooves 331, 331' which are angularly spaced apart from each other at an angle of 90° and which are respectively located at a front side and a lateral side of the corresponding insert post 33. The vertical rib 315 engages selectively one of the grooves 331, 331'. The tubular wall 313 is deformable between the vertical slits 318 so as to permit extension of one of the insert posts 33 between the transverse ribs 317.

Figure 3:
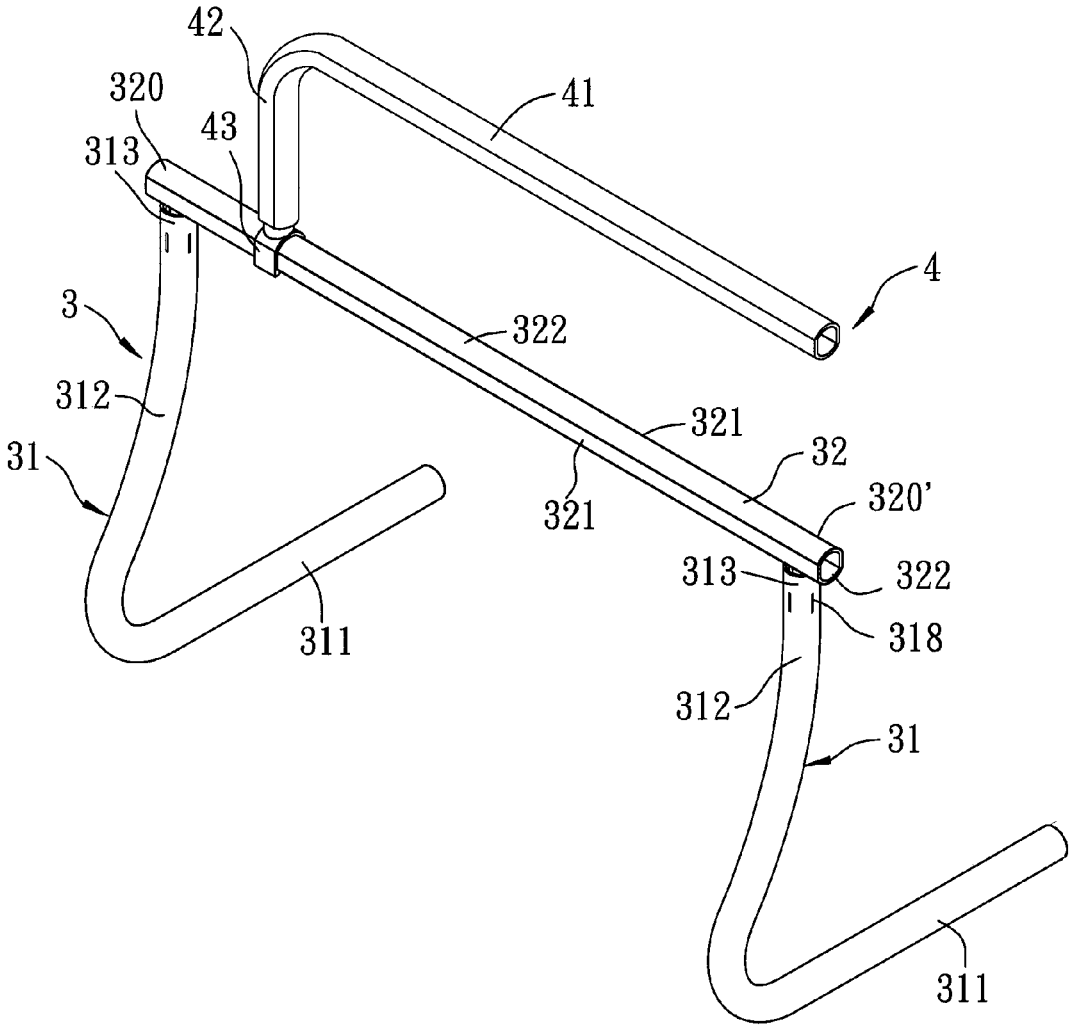
FIG. 3 is a perspective view of a hurdle assembly according to the first preferred embodiment of this invention.
Figure 5:
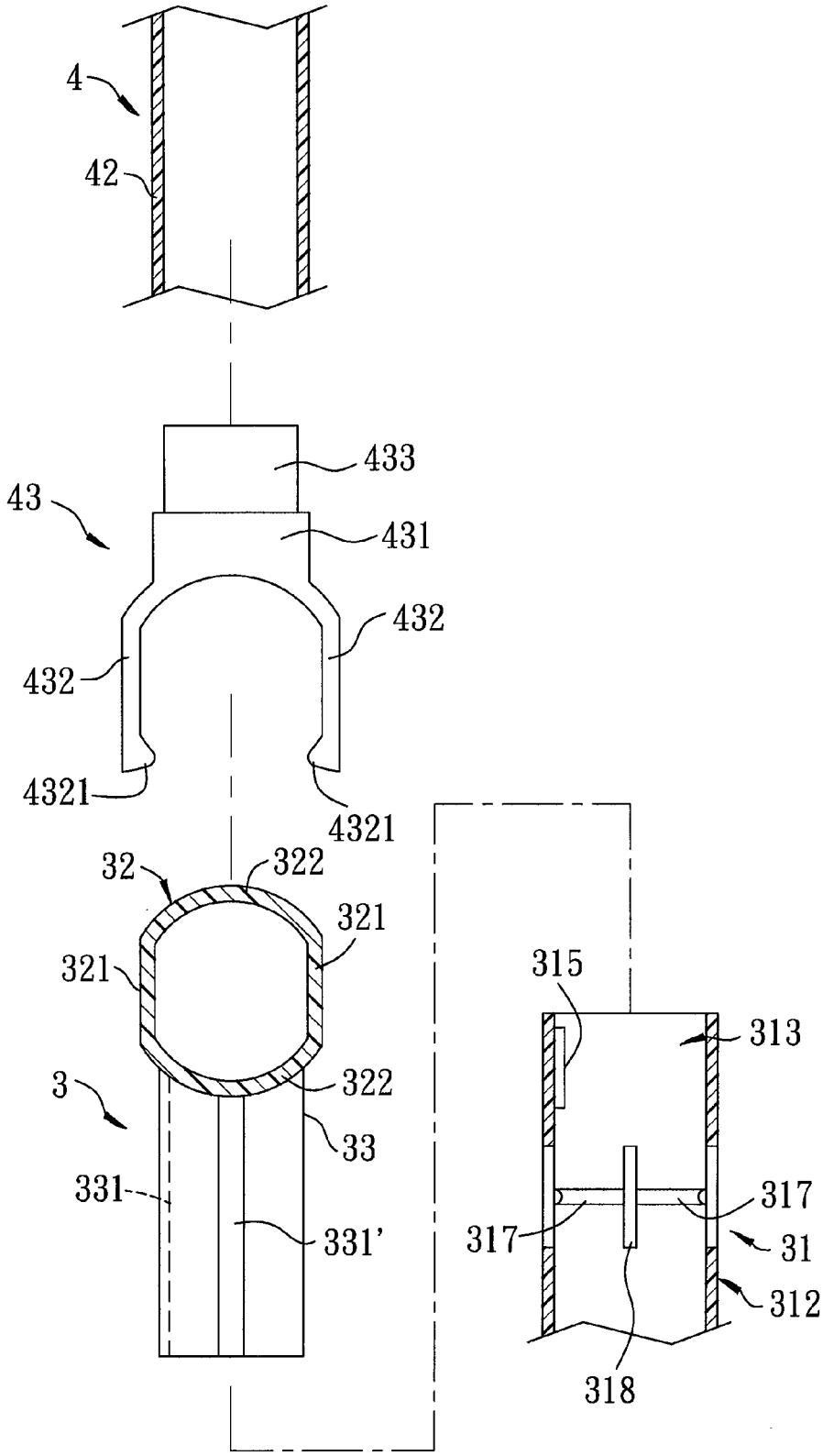
FIG. 5 is a fragmentary exploded sectional view of the first preferred embodiment.
Figure 6:
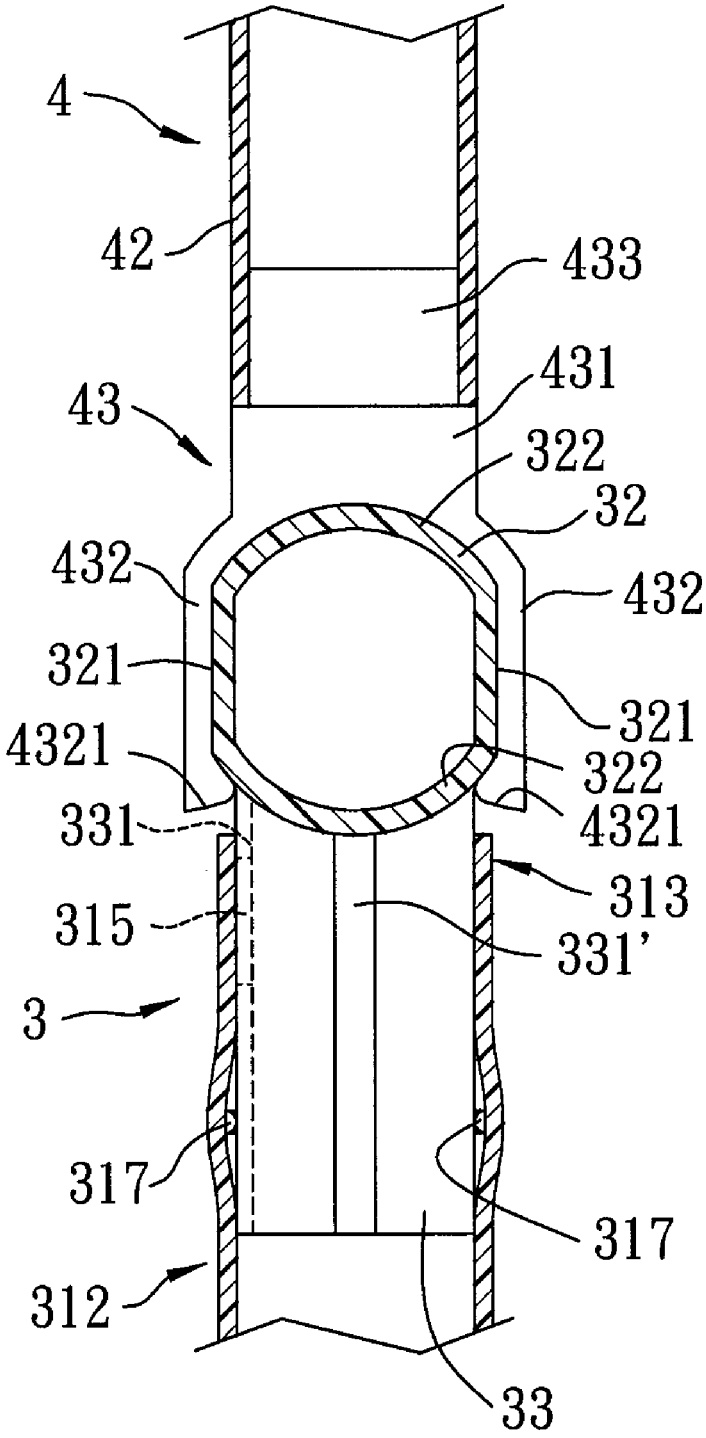
FIG. 6 is a fragmentary sectional view of the first preferred embodiment in an assembled state.

With reference to FIG. 3, the top frame 4 is L-shaped, and includes a first vertical support section 42, a barring section 41 that extends longitudinally and horizontally, that is parallel to the cross bar 32, and that has a first end connected to a top end of the first vertical support section 42, and a first clamp element 43 connected to a bottom end of the first vertical support section 42 and clamping releasably the cross bar 32 in proximity to the first end 320. With reference to FIGS. 5 and 6, the bottom end of the first vertical support section 42 is hollow, and the first clamp element 43 includes an intermediate section 431 abutting against the top rounded face 322 of the cross bar 32 between the front and rear flat faces 321 thereof, front and rear clamping plates 432 extending respectively and downwardly from front and rear ends of the intermediate section 431 and abutting respectively against the front and rear flat faces 321, and an insert section 433 extending upwardly from the intermediate section 431 and inserted into the bottom end of the first vertical support section 42. The clamping plates 432 have hook-ends 4321 abutting tightly against the bottom rounded face 322 of the cross bar 32. In this embodiment, the first clamp element 43 is connected detachably to the bottom end of the first vertical support section 42. In an alternative embodiment, the first clamp element 43 may be connected integrally to the bottom end of the first vertical support section 42 so as to form a unitary body during manufacture of the top frame 4.

To assemble the hurdle assembly of the present invention, the bottom frame 3 is first assembled. Only the right side of the bottom frame 3 will be described hereinafter for brevity's sake. With reference to FIGS. 4 to 6, the insert post 33 is inserted into the tubular wall 313 of the vertical leg section 312, and the vertical rib 315 engages the groove 331 so that the horizontal leg section 311 is at an angle of 90° relative to the cross bar 32. When the insert post 33 reaches the transverse ribs 317, portions of the tubular wall 313 between the vertical slits 318 are pushed outwardly, thereby permitting the insert post 33 to move past the transverse ribs 317. As the transverse ribs 317 abut tightly against the outer peripheral face of the insert post 33, the insert post 33 is not easily released from the tubular wall 313.

After the bottom frame 3 is assembled, the top frame 4 is attached to the cross bar 32 through the first clamp element 43 that clamps the cross bar 32 in proximity to the first end 320, as best shown in FIG. 3. The hurdle assembly of the present invention can be used for competition or training in this assembled state.

Figure 7:
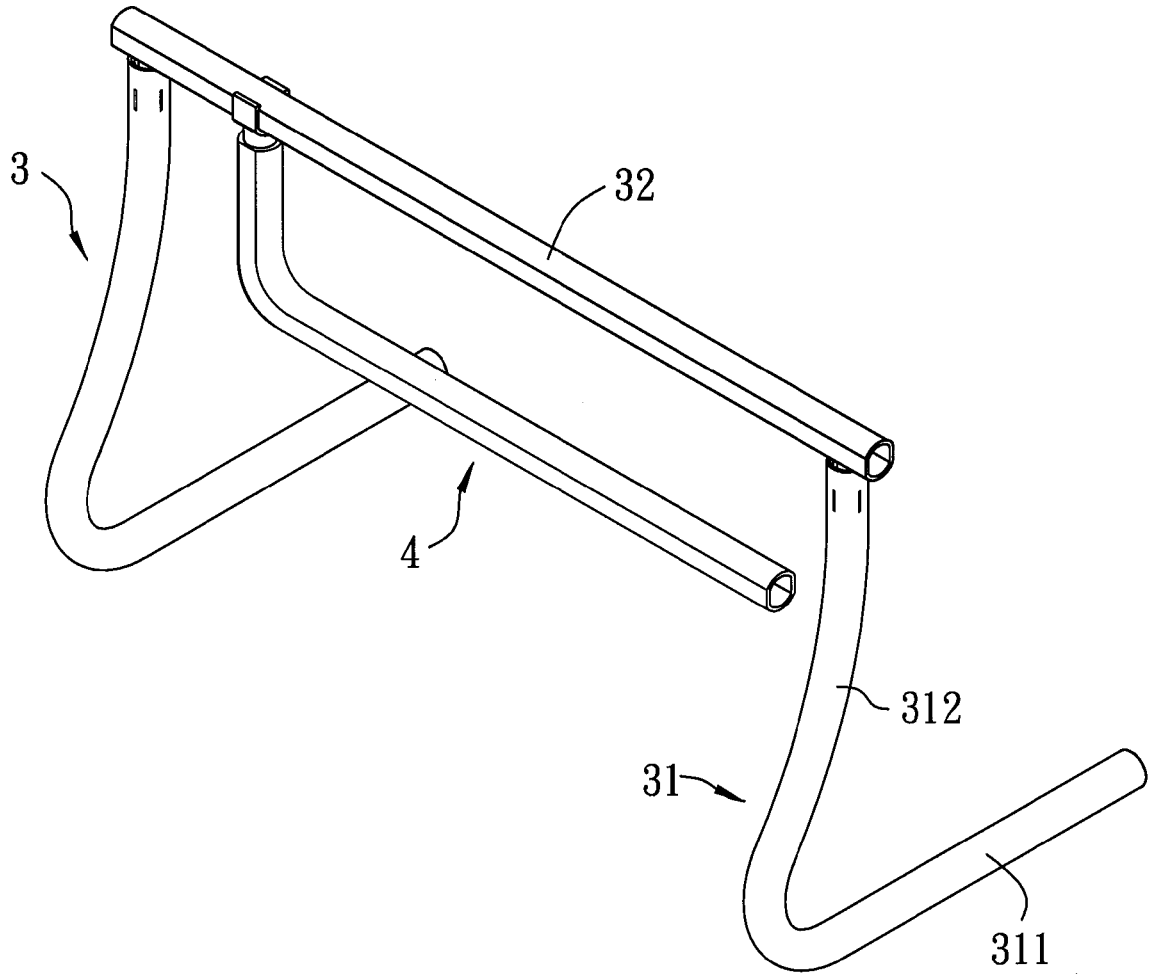
FIG. 7 is a view similar to FIG. 3, but with a top frame disposed below a cross bar.

In use, the position of the top frame 4 may be adjusted as desired. When an athlete desires to jump a high level, the top frame 4 may be turned upward to a position above the cross bar 32, as shown in FIG. 3. Alternatively, the top frame 4 may be turned downward to a position below the cross bar 32, as shown in FIG. 7, to lower the height of the hurdle assembly.

In comparing the structure of the present invention with that of the conventional hurdle assembly 1 (see FIG. 1), both have the bottom frame 3, 11 with substantially the same volume. However, the top frame 4 of the present invention is L-shaped, so that almost half of the volume of the conventional looped top frame 13 (see FIG. 1) is unneeded in the present invention. As a result, material costs of the hurdle assembly of the present invention can be minimized.

Figure 8:
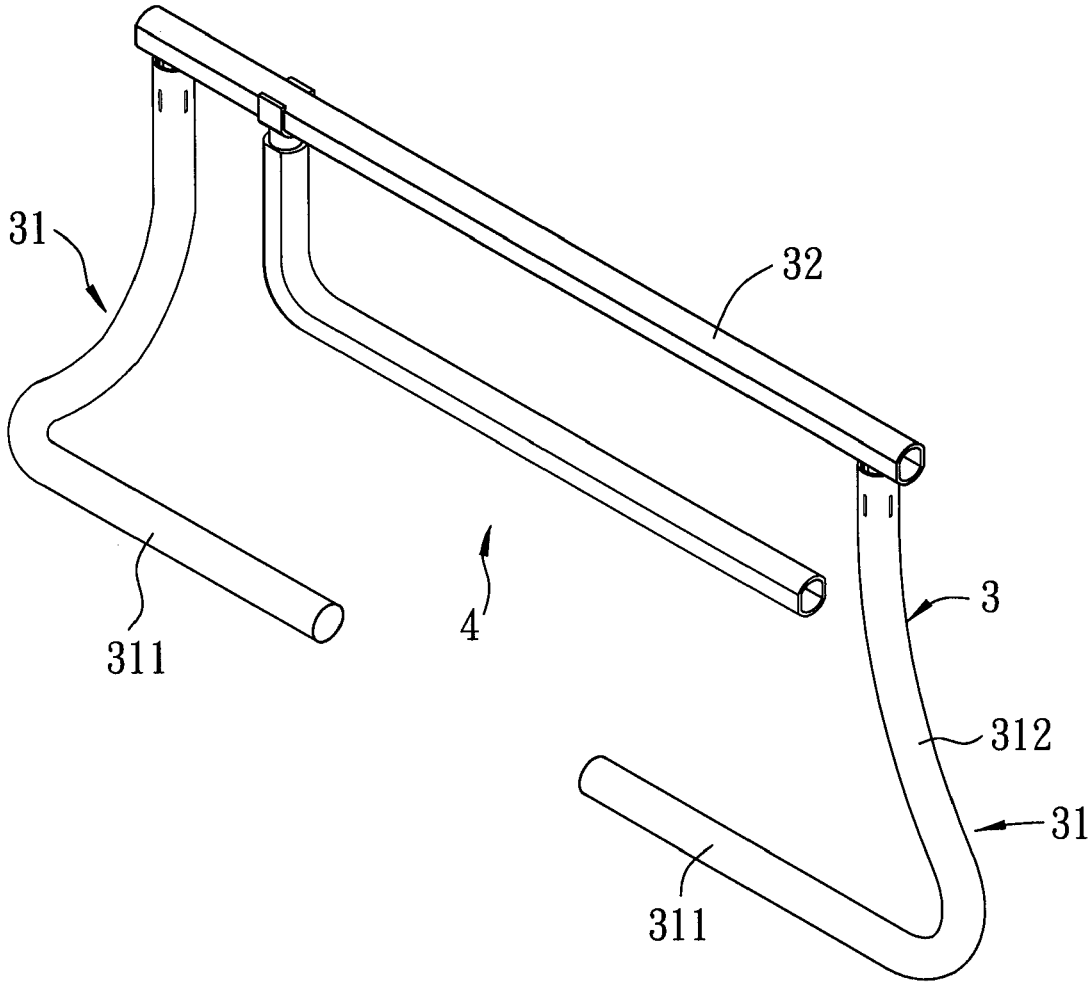
FIG. 8 is a view similar to FIG. 7, but with legs of a bottom frame disposed facing each other.

To store the hurdle assembly of the present invention, the top frame 4 is disposed below the cross bar 32, and each leg 31 is rotated inwardly at an angle of 90° so that the vertical rib 315 engages the groove 331', and rear ends of the horizontal leg sections 311 face each other, as best shown in FIG. 8. Since the top and bottom frames 4, 3 lie on the same plane at this time, the hurdle assembly of the present invention does not require a substantial space for storage. For the same reason, the transport cost can also be reduced to a minimum.

It is worth mentioning that, in this embodiment, the clamping plates 432 of the first clamp element 43 clamp onto the front and rear flat faces 321 of the cross bar 32 with the hook-ends 4321 abutting against the bottom rounded face 322 of the cross bar 32 so that the first clamp element 43 is restricted from rotation relative to the cross bar 32. Hence, the top frame 4 can be positioned stably on the bottom frame 3, and does not rotate relative to the cross bar 32 when bumped by an athlete.

Figure 9:
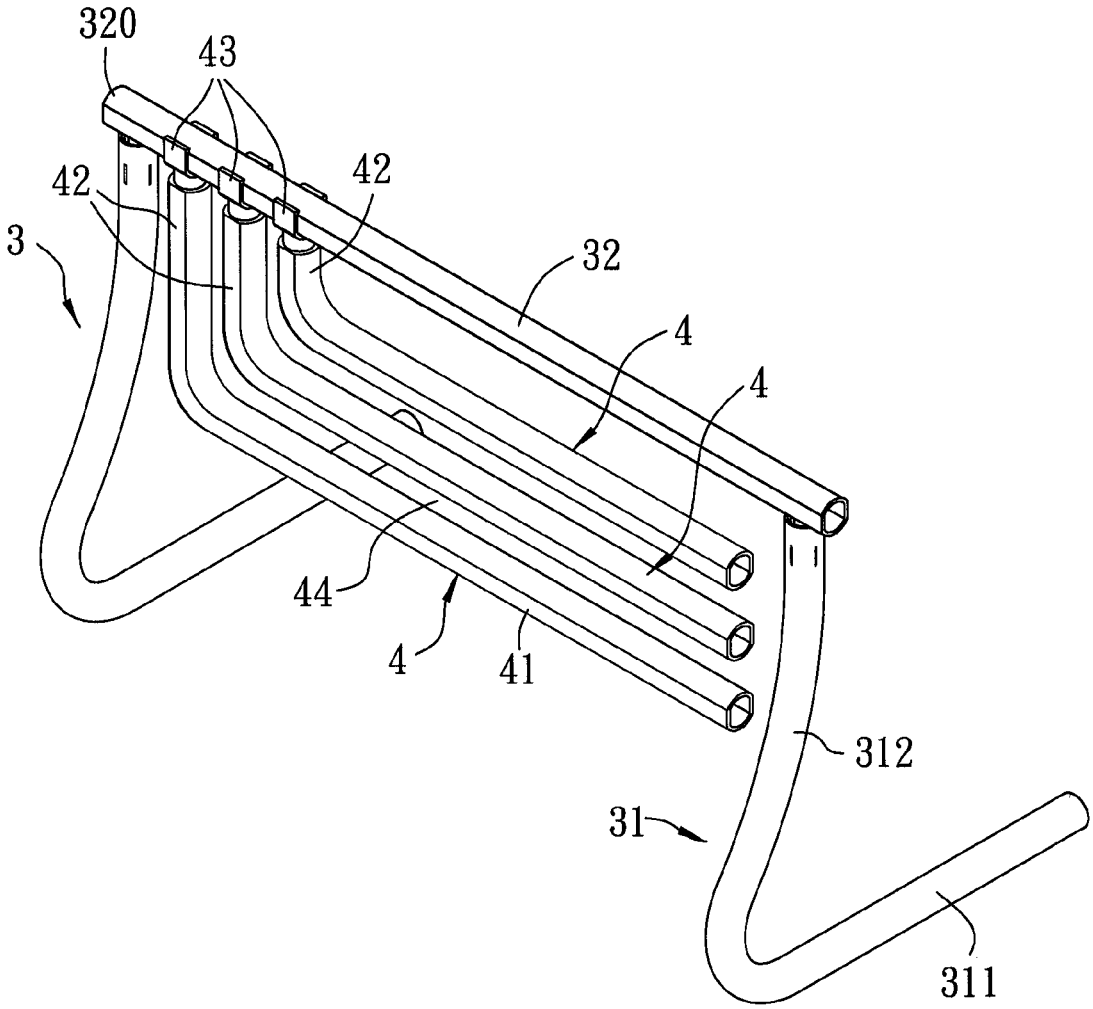
FIG. 9 is a perspective view of a hurdle assembly according to the second preferred embodiment of this invention.
Figure 10:
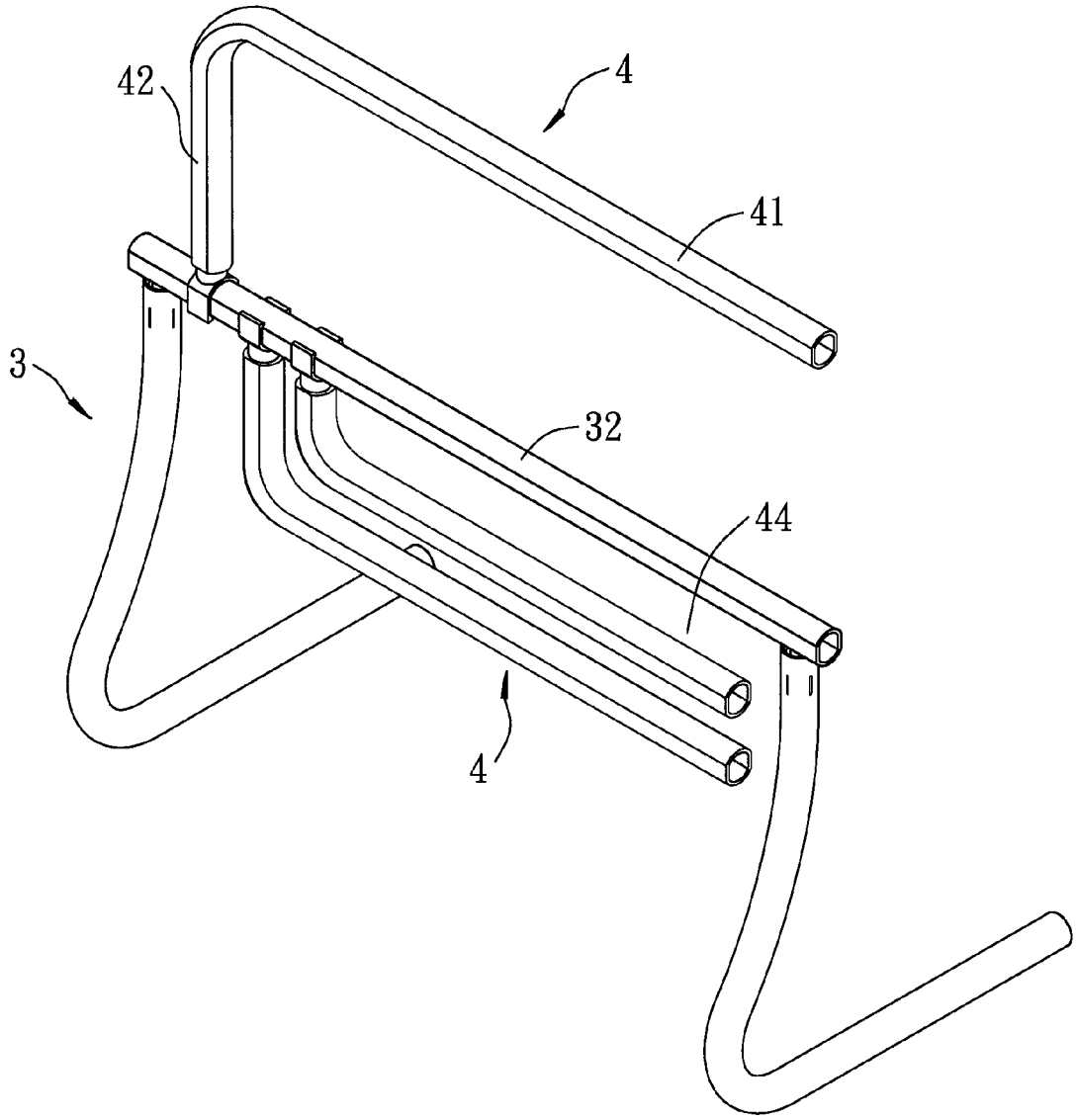
FIG. 10 is a view similar to FIG. 9, but with one top frame disposed above a cross bar.

Referring to FIGS. 9 and 10, a hurdle assembly according to the second preferred embodiment of the present invention is shown to be similar to the first preferred embodiment. However, in this embodiment, the hurdle assembly comprises a plurality of the top frames 4. The first vertical support sections 42 of the top frames 4 have different heights. The first clamp elements 43 of the top frames 4 clamp the cross bar 32 at longitudinally spaced apart positions. When any one of the top frames 4 is connected to the cross bar 32, the barring section 41, the first vertical support section 42, and the cross bar 32 cooperatively define a space 44 that may be used for receiving another top frame 4. In this embodiment, three of the top frames 4 are exemplified. The top frame 4 with the highest first vertical support section 42 is disposed nearest to the first end 320 of the cross bar 32, while the top frame 4 with the lowest first vertical support section 42 is disposed farthest from the first end 320.

To use the second preferred embodiment, with reference to FIG. 10, an athlete can selectively dispose one of the top frames 4 above the cross bar 32 in a manner that suits his or her jumping height requirements. Hence, in this embodiment, the effect of training an athlete to jump at different heights can be achieved.

Figure 11:
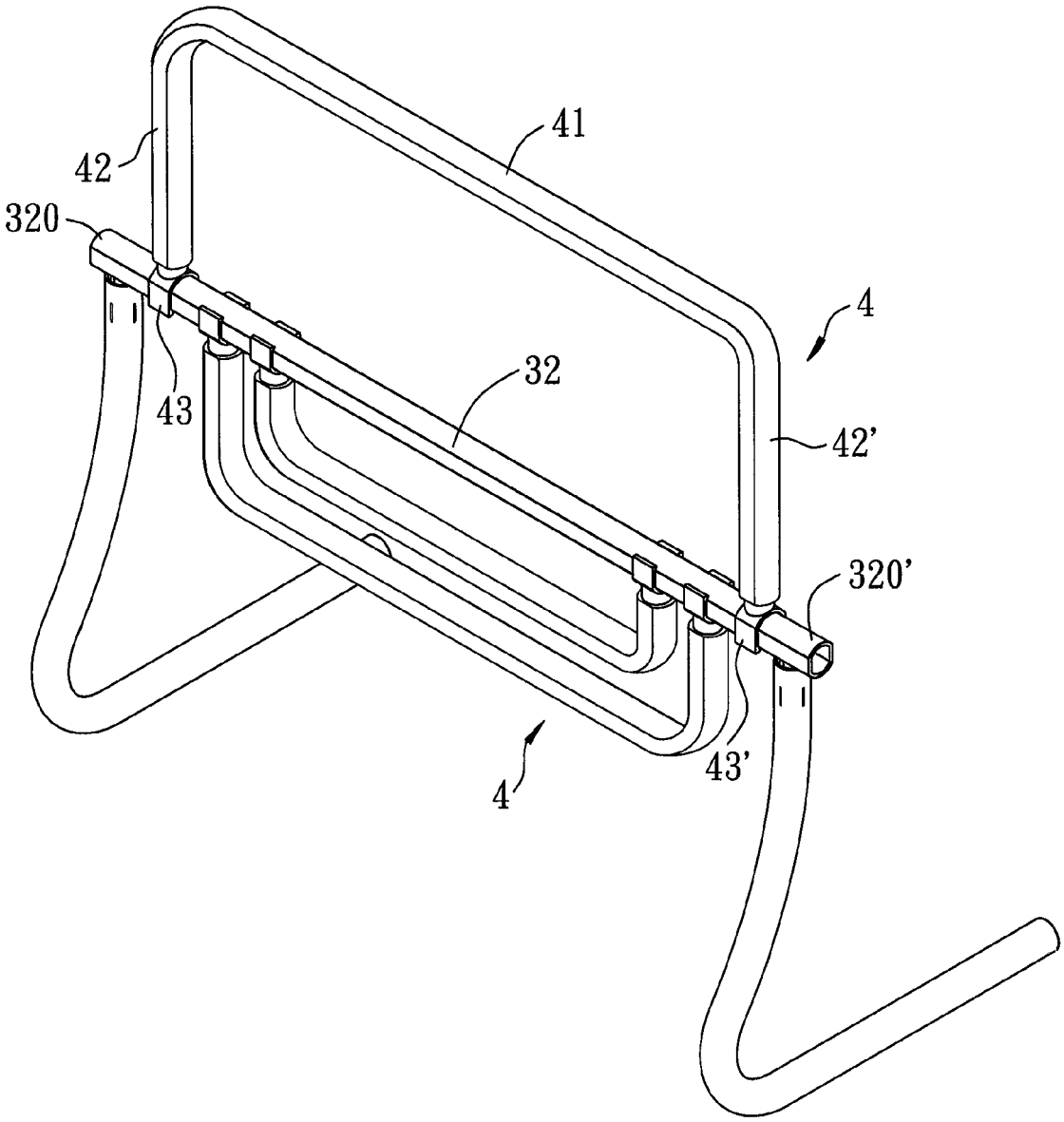
FIG. 11 is a perspective view of a hurdle assembly according to the third preferred embodiment of this invention.

Referring to FIG. 11, a hurdle assembly according to the third preferred embodiment of the present invention is shown to be similar to the second preferred embodiment. However, in this embodiment, each top frame 4 further includes a second vertical support section 42' having a top end connected to a second end of the barring section 41 which is longitudinally opposite to the first end of the barring section 41, and a second clamp element 43' connected to a bottom end of the second vertical support section 42'. The top frames 4 are U-shaped, and have different lengths and heights. The first clamp elements 43 of the top frames 4 clamp the cross bar 32 at longitudinally spaced apart positions in proximity to the first end 320 of the cross bar 32. The second clamp elements 43' of the top frames 4 clamp the cross bar 32 at longitudinally spaced apart positions in proximity to the second end 320' of the cross bar 32. The top frames 4 are arranged in such a manner that the top frame 4 that is highest and longest is disposed outermost, and the top frame 4 that is lowest and shortest is disposed innermost. Similarly, an athlete can selectively dispose one of the top frames 4 above the cross bar 32 in a manner that suits his or her jumping height requirements. Hence, the effect of training an athlete to jump at different heights can be achieved also using the third preferred embodiment.

Figure 12:
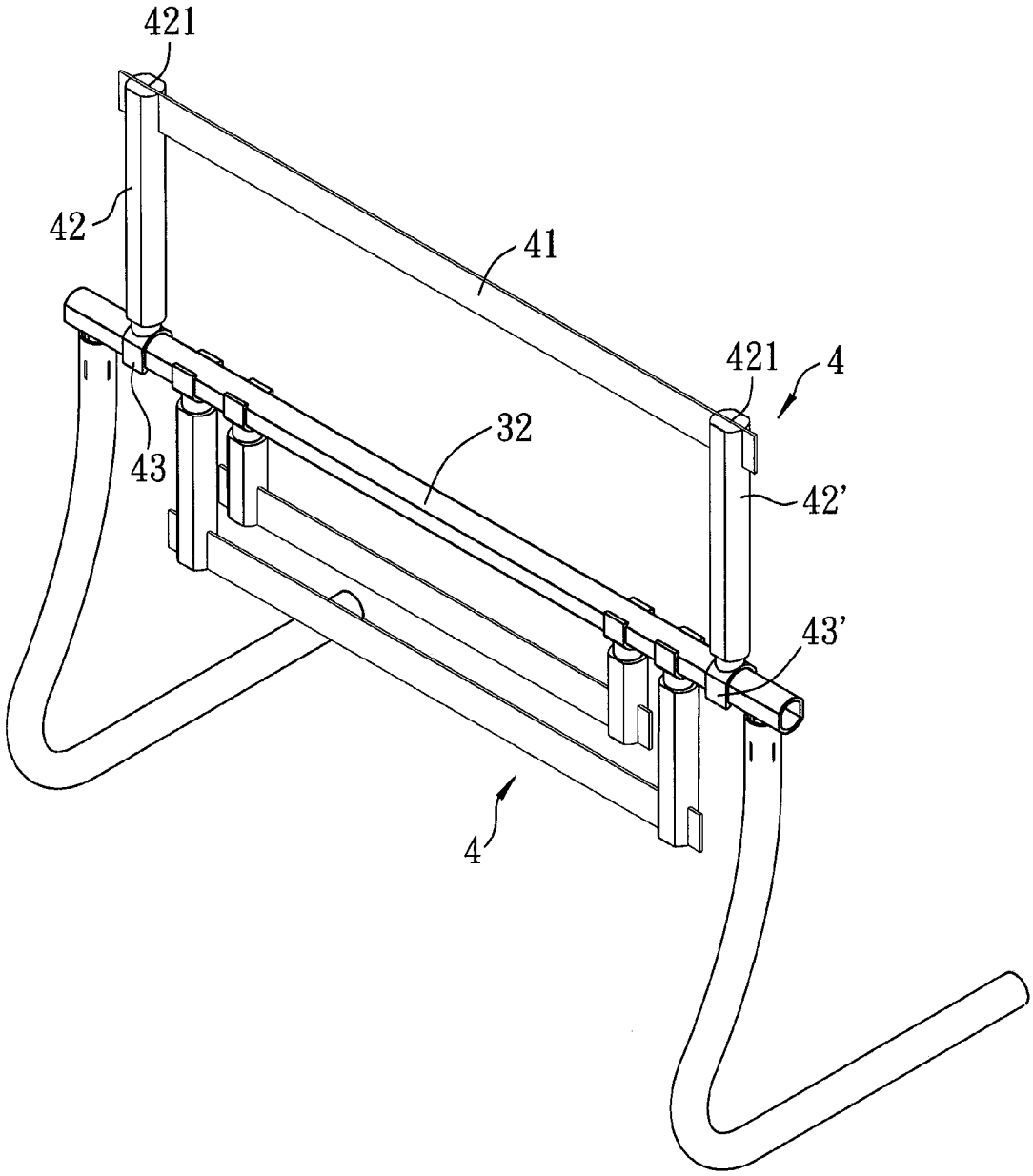
FIG. 12 is a perspective view of a hurdle assembly according to the fourth preferred embodiment of this invention.

Referring to FIG. 12, a hurdle assembly according to the fourth preferred embodiment of the present invention is shown to be similar to the third preferred embodiment. However, in this embodiment, the barring section 41 of each top frame 4 is configured as a flexible strap, and the top end of each of the first and second vertical support sections 42, 42' of each top frame 4 is formed with a clamping groove 421. Two opposite ends of the strap 41 are clamped respectively within the clamping grooves 421 of the first and second vertical support sections 42, 42'. Different heights of the hurdle assembly of the present invention can be achieved also in the fourth preferred embodiment. Further, by using the light-weight barring section 41, the center of gravity of the entire hurdle assembly can be lowered. Moreover, the flexible strap or barring section 41 can prevent injury to an athlete when the athlete bumps the barring section 41.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A hurdle assembly comprising:

a bottom frame including spaced-apart left and right legs, and a cross bar having a non-circular cross section, two longitudinally opposite first and second ends connected respectively to top ends of said left and right legs, longitudinal front and rear flat faces extending between said first and second ends, and longitudinal top and bottom rounded faces interconnecting said front and rear flat faces; and at least one top frame including a first vertical support section, a barring section extending longitudinally and horizontally parallel to said cross bar and having a first end connected to a top end of said first vertical support section, and a first clamp element connected to a bottom end of said first vertical support section and clamping releasably said cross bar in proximity to one of said first and second ends of said cross bar, said first clamp element having an intermediate section connected to said bottom end of said first vertical support section and abutting against said top rounded face between said front and rear flat faces, and front and rear clamping plates extending respectively and downwardly from said intermediate section and abutting respectively against said front and rear flat faces, said front and rear clamping plates having hook-ends abutting tightly against said bottom rounded face.

2. The hurdle assembly of claim 1, wherein said intermediate section of said first clamp element is connected integrally to said bottom end of said first vertical support section to form a unitary body.

3. The hurdle assembly of claim 1, wherein said bottom end of said first vertical support section is hollow, and said first clamp element further includes an insert section extending upwardly from said intermediate section and inserted into said bottom end of said first vertical support section.

4. A hurdle assembly comprising:

a bottom frame including spaced-apart left and right legs, and a cross bar having two longitudinally opposite first and second ends connected respectively to top ends of said left and right legs; and a plurality of top frames each including a first vertical support section, a barring section extending longitudinally and horizontally parallel to said cross bar and having a first end connected to a top end of said first vertical support section, and a first clamp element connected to a bottom end of said first vertical support section and clamping releasably said cross bar in proximity to one of said first and second ends of said cross bar, said first vertical support sections of said top frames having different heights, said first clamp elements of said top frames clamping said cross bar at longitudinally spaced apart positions.

5. A hurdle assembly comprising:

a bottom frame including spaced-apart left and right legs, and a cross bar having two longitudinally opposite first and second ends connected respectively to top ends of said left and right legs; and a plurality of top frames, each including a first vertical support section, a barring section extending longitudinally and horizontally parallel to said cross bar and having a first end connected to a top end of said first vertical support section and a second end longitudinally opposite to said first end of said barring section, a second vertical support section having a top end connected to said second end of said barring section, a first clamp element connected to a bottom end of said first vertical support section and clamping releasably said cross bar in proximity to one of said first and second ends of said cross bar, and a second clamp element connected to a bottom end of said second vertical support section and clamping said cross bar in proximity to the other one of said first and second ends of said cross bar, wherein said top frames have different lengths and heights, said first clamp elements of said top frames clamping said cross bar at longitudinally spaced apart positions in proximity to said first end of said cross bar, and said second clamp elements of said top frames clamping said cross bar at longitudinally spaced apart positions in proximity to said second end of said cross bar.

6. The hurdle assembly of claim 1, wherein said cross bar has two insert posts extending downwardly and respectively from said first and second ends of said cross bar, each of said left and right legs being substantially L-shaped, said top end of each of said left and right legs having a tubular wall for receiving engagingly one of said insert posts.

7. The hurdle assembly of claim 6, wherein each of said insert posts has an outer peripheral face provided with two vertically extending grooves which are angularly spaced apart from each other, said tubular wall being provided with a vertical rib that projects inwardly from said tubular wall and engaging selectively one of said grooves.

8. The hurdle assembly of claim 6, wherein said tubular wall has a plurality of angularly spaced-apart vertical slits, and at least one pair of diametrically opposed transverse ribs each projecting inwardly and transversely from said tubular wall between two adjacent ones of said vertical slits, said transverse ribs abutting tightly against one of said insert posts, said tubular wall being deformable between said vertical slits to permit extension of one of said insert posts between said transverse ribs.

9. The hurdle assembly of claim 5, wherein said barring section is configured as a flexible strap, and said top end of each of said first and second vertical support sections is provided with a clamping groove to clamp one of two opposite ends of said strap.

* * * * *